United States Patent [19]

Lum

[11] Patent Number: 4,746,592

[45] Date of Patent: May 24, 1988

[54] COLOR CORRECTION IN NEGATIVE IMAGES USING POSITIVE IMAGING CHEMISTRY

[75] Inventor: Kin K. Lum, Rochester, N.Y.

[73] Assignee: Eastman Kodak Company, Rochester, N.Y.

[21] Appl. No.: 900,938

[22] Filed: Aug. 27, 1986

[51] Int. Cl.[4] ..... G03C 5/54; G03C 7/26

[52] U.S. Cl. ..... 430/223; 430/222; 430/241; 430/242; 430/359; 430/212; 430/236

[58] Field of Search ..... 430/223, 222, 359, 212, 430/242, 241, 236

[56] References Cited

U.S. PATENT DOCUMENTS

| | | | |
|---|---|---|---|
| 3,585,028 | 6/1971 | Stephens | 430/223 |
| 4,139,379 | 2/1979 | Chasman et al. | 430/223 |
| 4,199,355 | 4/1980 | Hinshaw et al. | 430/223 |
| 4,379,604 | 2/1983 | Van de Sande et al. | 430/223 |
| 4,391,896 | 7/1983 | Maier et al. | 430/223 |

FOREIGN PATENT DOCUMENTS

| | | |
|---|---|---|
| 2082340 | 3/1982 | United Kingdom . |
| 2089054 | 6/1982 | United Kingdom . |

OTHER PUBLICATIONS

The Theory of the Photographic Process, Mees, 4th Ed., 1977, MacMillan Publishing Co., pp. 571–572.

*Primary Examiner*—Richard L. Schilling
*Attorney, Agent, or Firm*—Thomas F. Kirchoff

[57] ABSTRACT

Color correction of negative images resulting from diffusion transfer photographic recording materials is obtained through use of two dye image-providing compounds, each of which is capable of releasing a diffusible dye. One of the dye image-providing compounds releases a diffusible dye as a result of silver halide development whereas the other compound releases dye in areas where no development occurs.

7 Claims, No Drawings

COLOR CORRECTION IN NEGATIVE IMAGES USING POSITIVE IMAGING CHEMISTRY

This invention relates to photographic recording materials and in particular to correction of negative dye images derived from color diffusion transfer photographic recording materials.

The need for color correction arises from the reality that absorption spectra of dyes employed in photographic applications, including color diffusion transfer applications, are less than perfect. Such dyes invariably have significant spectral absorption in regions other than that desired. For example, many commercially recognized magenta imaging dyes are too red. This imperfection is caused by unwanted absorption in the blue region of the spectrum. Such shortcomings are particularly troublesome in a so-called "two-stage" photographic system where a color negative is first produced and is then used as an intermediate in the preparation of a final print or transparency.

With suitable color correction techniques a two-stage process can provide the ability to obtain optimum quality positive image prints. Two-stage techniques allow flexibility in adjustment of contrast and color-balance. Other advantages include permitting adjustment in size and shape of a print for purposes of framing. Also, relatively inexpensive multiple copies and enlargements, as well as a choice of surface finish for resulting color prints, are feasible by use of color-corrected diffusion transfer dye negative intermediates.

The overall quality of conventional photographic color prints made from a negative intermediate is generally higher when compared with color prints derived from reversal or direct-positive recording materials. The Theory of the Photographic Process, Mees, 4th Ed., 1977, MacMillan Publishing Co., pp. 571–572, discusses the need for color correction in conventional photographic products. This publication recognizes that color correction can be effected through use of photographic masking or with color couplers incorporated in photographic materials. However, color couplers cannot be used in commercial diffusion transfer processes because they are not compatible with such systems. Color image transfer materials have traditionally been positive working to provide images for direct final viewing. While a two-stage system is desirable, the problem of print-through of unwanted dye absorption has not heretofore been resolved. At the present time there appears to be no described technique for color correcting a negative dye intermediate obtained from diffusion transfer photographic recording materials.

Accordingly, the object of this invention is to provide a photographic recording material and a process for obtaining color correction in a negative intermediate derived from a color diffusion transfer photographic process.

A color diffusion transfer photographic recording material in accordance with this invention comprises a support having thereon at least one photosensitive silver halide emulsion layer having associated therewith two nondiffusible dye image-providing compounds, each of which compound is capable of releasing a diffusible dye, wherein one of said compounds provides dye relative to exposed silver halide and the other of said compounds provides dye relative to unexposed silver halide.

One of the initially nondiffusible dye image-providing compounds is a "principal" compound in that it releases a dye which diffuses to an image-receiving layer to form a principal, or main, dye image. The other initially immobile dye image-providing compound is a "secondary" compound inasmuch as the dye which it releases, and which also diffuses to the image-receiving layer, is used for color correction of the principal dye image.

While the choice of image-providing compound used to supply dye for the principal image is important, the thrust of this invention hinges upon the image-providing compound used to supply the color correcting dye. This color correcting dye is released in a manner which is opposite from the manner of release of the dye obtained from the principal image-providing compound.

The manner of dye release is relative to silver halide development. For example, where the principal image-providing compound releases dye as a direct function of silver halide development the secondary compound must release dye as an indirect function of silver halide development. The secondary release provides a dye having a hue sufficient to correct the effects of undesired absorption in the main or imaging dye.

The "principal" or main dye image-providing compound useful in this invention can be either positive-working or negative-working. Examples of useful positive-working, initially immobile dye image-providing compounds include those disclosed in U.S. Pat. Nos. 3,980,479; 4,199,354; 4,199,355 and 4,278,598, the disclosures of which are hereby incorporated by reference. These compounds, which release dyes anchimerically unless the compound is oxidized, include those having the following structural formula:

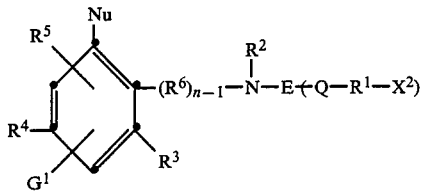

wherein

Nu is an oxidizable nucleophilic group such as —OH, —$NH_2$, hydroxylamino, sulfonamido, or a precursor for said oxidizable nucleophilic group such as —$OR^7$ or —$NHR^7$, where $R^7$ is an alkali-labile group such as formyl, acyl, carbobenzoxy, oxalate or halogenated acetyl containing from 1 to 15 carbon atoms, including cyclic groups formed with substituents for $R^5$ when $R^5$ is positioned ortho to Nu;

E is carbonyl or thiocarbonyl;

Q is a bivalent group providing a mono atom linkage between E and $R^1$ wherein said mono atom is a nonmetallic atom of group VA or VIA of the periodic table in its minus 2 or minus 3 valence state such as a nitrogen, oxygen, sulfur or selenium atom, wherein said mono atom provides two covalent bonds linking E to $R^1$, and when Q is a trivalent atom it can be mono-substituted with a hydrogen atom, an alkyl group having from 1 to 10 carbon atoms, including substituted alkyl groups, or an aromatic group containing from 6 to 20 carbon atoms, including substituted aromatic groups;

$G^1$ is an hydroxy group or a precursor therefor, a primary amino group or a precursor therefor, or a substituted amino group such as a dialkylamino group, or any of the substituents defined for Nu, including cyclic groups formed with $R^4$ or $R^5$;

$R^1$ is an unsubstituted or a substituted aromatic carbocyclic group containing from 6 to 20 carbon atoms, which preferably is phenylene or naphthalene; or an unsubstituted or substituted aromatic heterocyclic group having from 6 to 20 total atoms in the ring system, such as pyridine or isoquinoline; or $R^1$ can be an unsubstituted or substituted alkylene group containing from 1–12 carbon atoms;

$R^2$ is an unsubstituted or a substituted alkyl group containing from 1 to 40 carbon atoms, an unsubstituted or a substituted cycloalkyl group containing from 5 to 7 carbon atoms in the ring, an unsubstituted or a substituted aryl group containing from 6 to 20 carbon atoms, or the substituent $X^1$;

$R^3$, $R^4$ and $R^5$ each independently can be a monoatomic group which can be hydrogen or halogen; or a polyatomic group which can be unsubstituted or substituted alkyl or alkoxy having from 1 to 40 carbon atoms, cycloalkyl having from 5 to 7 carbon atoms in the ring, or an unsubstituted or substituted aryl group having from 6 to 40 carbon atoms; or carbonyl, sulfamyl, sulfonamido, or the substituent $X^1$; or $R^3$ and $R^5$, or $R^4$ and $R^5$, when on adjacent positions on the ring, can be taken together to form a 5- to 7-membered ring with the remainder of the molecule, with the proviso that when $R^1$ is an alkylene group, $R^3$ and $R^4$ are polyatomic groups, and when $G^1$ is a substituent as defined for Nu, the $R^3$ or $R^4$ substituent adjacent to $G^1$ can be the group:

$$\text{-}(R^6)_{n-1}\text{-}\overset{\overset{\displaystyle R^2}{|}}{N}\text{-}E\text{-}(R^1\text{-}X^2);$$

$X^1$ and —(—$R^1$—$X^2$) each represents a ballast group of sufficient size to render said compound immobile in an alkali-permeable layer of a photographic recording material or a photographically useful moiety, provided one of $X^1$ and (—$R^1$—$X^2$) is a ballast group and the other is a photographically useful moiety;

$R^6$ is an unsubstituted or substituted alkylene group having from 1 to 3 atoms;

n is a positive integer of 1 or 2.

Also included within the definition of positive-working, initially immobile dye image-providing compounds are those which, upon reduction followed by an intramolecular nucleophilic displacement reaction, releases dyes anchimerically. This type of compound is described in U.S. Pat. Nos. 4,139,379 and 4,139,389, the disclosures of which are hereby incorporated by reference. Such compounds include ballasted electron-accepting nucleophilic displacement (BEND) compounds having the following structural formula:

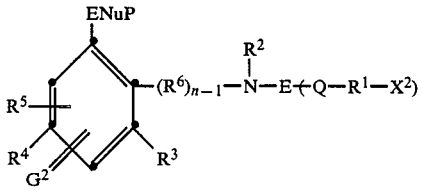

wherein

ENuP is an electron-accepting nucleophilic precursor group for an hydroxy nucleophilic group, including imino groups, and preferably oxo groups;

$G^2$ is an imino group, including alkylimino, sulfonimido, a cyclic group formed with $R^3$ or $R^4$, or any of the groups specified for ENuP, and preferably $G^2$ is para to ENuP; and $R^1$, $R^2$, $R^3$, $R^4$, $R^5$, $R^6$, E, Q, $X^2$ and n are as defined above.

In the above formulae, $R^6$ is selected to provide substantial proximity of E, respectively, to the nucleophilic group Nu, or to the nucleophilic precursor group ENuP, in order to permit intramolecular nucleophilic cleavage of Q from E. $R^6$ is preferably selected to provide 3 to 5 atoms between the atom which is the nucleophilic center of said nucleophilic group and the atom which is the electrophilic center of said electrophilic group (E), whereby said BEND compounds are capable of forming 5- to 8-membered rings, and preferably 5- or 6-membered rings, upon intramolecular nucleophilic displacement of the group —(Q—$R^1$—$X^2$) from E.

Negative-working, initially immobile dye image-providing materials which can be used to form the principal or main dye image, are ballasted, redox dye-releasing (RDR) compounds. Such compounds are well known to those skilled in the art and, generally, are compounds which react with oxidized or unoxidized developing agent or electron transfer agent to release a dye. Such initially immobile RDR compounds include those described in U.S. Pat. Nos. 3,728,113; 3,725,062; 3,698,897; 3,628,952; 3,443,939; 3,443,940; 4,053,312; 4,076,529; 4,055,428; 4,149,892; 4,198,235 and 4,179,291; and as described in Research Disclosure 15157, November 1976 and Research Disclosure 15654, April, 1977, the disclosures of which are incorporated herein by reference.

In a preferred embodiment of this invention, negative-working RDR compounds, such as those in U.S. Pat. Nos. 4,055,428 and 4,076,529, referred to above, are employed for the principal or main image formation. These RDR's compounds are ballasted sulfonamido compounds which are alkali-cleavable upon oxidation to release a diffusible dye from the nucleus. They have the general structural formula:

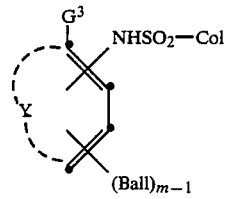

wherein (a) Col is a dye or dye precursor moiety;

(b) Ball is an organic ballasting radical of such molecular size and configuration (e.g., simple organic groups or polymeric groups) as to render the compound nondiffusible in the photosensitive element during development in an alkaline processing composition;

(c) $G^3$ is $OR^8$ or $NHR^9$ wherein $R^8$ is hydrogen or a hydrolyzable moiety and $R^9$ is hydrogen or a substituted or unsubstituted alkyl group of 1 to 22 carbon atoms, such as methyl, ethyl, hydroxyethyl, propyl, butyl, secondary butyl, tertiary butyl, cyclopropyl, 4-chlorobutyl, cyclobutyl, 4-nitroamyl, hexyl, cyclohexyl, octyl, decyl, octadecyl, docosyl, benzyl or phenethyl, and when $R^9$ is an alkyl group of greater than 6 carbon atoms, it can serve as a partial or sole ballast group;

(d) Y represents the atoms necessary to complete a benzene nucleus, a naphthalene nucleus or a 5- to 7-membered heterocyclic ring such as pyrazolone or pyrimidine; and (e) m is a positive integer or 1 to 2 and is 2 when $G^3$ is $OR^8$ or when $R^9$ is a hydrogen or an alkyl group of less than 8 carbon atoms.

In the above structural formualae the groups $X^1$, $R^1$—$X^2$ and Ball may each represent ballast groups. The particular nature of such groups is not critical. The important consideration is that the respective groups confer nondiffusibility to the dye image-providing compounds. Typical ballast groups, as defined in the patents noted above include long-chain alkyl radicals linked directly or indirectly to the compounds, as well as aromatic radicals of the benzene and naphthalene series indirectly attached or fused directly to these radicals.

These positive- and negative-working, initially immobile compounds can be incorporated in a photographic element where they are initially incapable of releasing a diffusible dye. During photographic processing under alkaline conditions they release diffusible dyes by undergoing intramolecular nucleophilic displacement reactions. Whatever RDR compounds are employed it is essential that they be compatible in the processing environment in which they are used.

With respect to the relative amounts of principal and secondary RDR compounds which are employed, this will be controlled by the type and quality of diffusible dyes which are released. For example, when the principal RDR compound releases a dye having low levels of absorption in unwanted wavelength areas, a relatively small amount of the secondary color correcting dye need to be released. Generally, the "purer" the dye, that is the less unwanted absorption present in a main or principal dye, the less need there is for color correction. Conversely, where the principal dye has relatively higher levels of absorption in a wavelength area outside the desired region of absorption, a relatively larger amount of secondary color correcting dye will be needed to assure obtaining the sought-after improvements of this invention.

The amount of nondiffusible RDR compound which should be employed in order to release sufficient dye for the desired color correction can be as much as about 35% by weight of the amount of nondiffusible RDR compound employed for the principal imaging. Generally, use of from about 10% to about 25% by weight of the secondary RDR compound, based on the weight of the principal RDR compound, will be sufficient to provide the desired color correction. Where too large an amount of secondary dye is released, over-correction of color can result. This effect is illustrated in Example 2 below.

The photographic element described above can be treated in any manner with an alkaline processing composition to effect or initiate development. A preferred method for applying processing composition is by use of a rupturable container or pod which contains the composition. Such method is well known and is described in one or more of the patents noted above. In general, the processing composition contains a developing agent, although the composition could be an alkaline solution with the developing agent being incorporated in the photographic element or cover sheet. In the latter case the alkaline solution serves to activate the incorporated developer.

A photographic assemblage in accordance with this invention comprises:

(a) a photographic element comprising a support having thereon at least one photosensitive silver halide emulsion layer having associated therewith two nondiffusible dye image providing compounds capable of releasing a diffusible dye, wherein one of said compounds provides dye relative to exposed silver halide and the other of said compounds provides dye relative to unexposed silver halide;

(b) a dye-image receiving layer; and (c) an alkaline processing composition with means for discharging same within said assemblage;

said assemblage also comprising a silver halide developing agent.

When the means for discharging the processing composition is a rupturable container, it is usually positioned in relation to the photosensitive, or image-generating, layers and an image-receiving layer so that acompressive force applied to the container by pressure-applying members, such as would be found in a typical camera used for in-camera processing, will effect a discharge of the container's contents between the photosensitive and the image-receiving layers. After processing, the dye image-receiving layer is separated from the photosensitive layers.

The dye image-receiving layer in the above described film assemblage is optionally located on a separate support adapted to be superposed on the photographic element after exposure thereof. Such image-receiving elements are generally disclosed, for example, in U.S. Pat. No. 3,362,819.

In another embodiment, the dye image-receiving layer in the above-described film assemblage is integral with the photographic element and is located between the support and the lowermost photosensitive silver halide emulsion layer. One useful format for integral negative-receiver photographic elements is disclosed in Belgian Pat. No. 757,960.

Another format for integral negative-receiver photographic elements in which the present invention is useful is disclosed in Canadian Pat. No. 928,559. In this embodiment, the support for the photographic element is transparent and is coated with a dye image-receiving layer, a substantially opaque, light-reflective layer and a photosensitive layer or layers described aove. A rupturable container, containing an alkaline processing composition and an opacifier, is positioned between the top layer of the negative-receiver element and a transparent cover sheet which has thereon, in sequence, a neutralizing layer, and a timing layer.

Still other useful integral formats in which this invention can be employed are described in U.S. Pat. Nos. 3,415,644; 3,415,645; 3,415,646; 3,647,437 and 3,635,707.

A process for producing a color corrected photographic transfer image accoring to this invention comprises:

(I) imagewise exposing a photosensitive element comprising a support having thereon at least one photosensitive silver halide emulsion layer having associated therewith two nondiffusible redox dye releasing compounds, each capable of releasing a diffusible dye, wherein one of said compounds releases dye relative to exposed silver halide and the other of said compounds releases dye relative to unexposed silver halide;

(II) treating the exposed element with an alkaline processing composition in the presence of a silver halide developing agent to effect development of each exposed silver halide emulsion layer, whereby:

(a) an imagewise distribution of a principal dye image-providing material is formed as a function of development of the silver halide layer and, simultaneously, (b) an imagewise distribution of a secondary dye image-providing material is also formed corresponding to areas of unexposed and undeveloped silver halide, and (c) at least a portion of each of said imagewise distributions of dye image-providing material diffuses to a dye image-receiving layer to provide color correction in the principal transferred dye image; and, optionally, (III) separating the dye image-receiving layer from the remainder of the photosensitive element.

A photographic recording material of this invention can be used to produce images in single or multicolors. In a three-color system, each silver halide emulsion layer of the film assembly will have associated therewith dye image-providing material which processes a predominant spectral absorption within the region of the visible spectrum to which said silver halide emulsion is sensitive, i.e., the blue-sensitive silver halide emulsion layer will have yellow dye image-providing material associated therewith, the green-sensitive silver halide emulsion layer will have magenta dye image-providing material associated therewith and the red-sensitive silver halide emulsion layer will have cyan dye image-providing material associated therewith. Dye image-providing material associated with each silver halide emulsion layer, including such material employed for color correction, is contained either in a silver halide emulsion layer itself or in a layer contiguous to the silver halide emulsion layer, i.e., the dye image-providing material can be coated in a separate layer underneath the silver halide emulsion layer with respect to the exposure direction.

The concentration of the principal dye image-providing material that is employed in the present invention can be varied over a wide range, depending upon the particular compound employed and the results desired. For example, the principal dye image-providing material coated in a layer at a concentration of 0.1 to 3 g/m$^2$ has been found to be useful. The dye image-providing material is usually dispersed in a hydrophilic film forming natural material or synthetic polymer, such as gelatin, polyvinyl alcohol, etc. which is adapted to be permeated by aqueous alkaline processing composition. As noted above, the amount of secondary dye image-providing compound may be as much as about 35% by weight of the amount of RDR used for the principal image formation.

A variety of silver halide developing agents are useful in this invention. Specific examples of developers or electron transfer agents (ETA's) useful in this invention include hydroquinone compounds, aminophenol compounds, catechol compounds, 3-pyrazolidinone compounds, such as those disclosed in column 10 of U.S. Pat. No. 4,358,527. A combination of different ETA's, such as those disclosed in U.S. Pat. No. 3,039,869, can also be employed. These ETA's are employed in the liquid processing composition or contained, at least in part, in any layer or layers of the photographic element or film assemblage where they are activated by the alkaline processing composition, such as in the silver halide emulsion layers, the dye image-providing material layers, interlayers or the image-receiving layer.

The silver halide emulsions useful in this invention, both negative-working and direct-positive types, are well known to those skilled in the art and are described in Research Disclosure, Volume 176, December 1978, Item 17643, pages 22 and 23, entitled "Emulsion preparation and types", the disclosure of which is hereby incorporated by reference. The emulsions are usually chemically and spectrally sensitized emulsion layers. Either conventional negative-working or direct-positive silver halide emulsions are employed. If the silver halide emulsion employed is a direct-positive silver halide emulsion, sucy as an internal image emulsion or a fogged, direct-positive emulsion, such as a solarizing emulsion which is developable in unexposed areas, a positive image can be obtained on the dye image-receiving layer by using negative working ballasted, redox dye-releasers.

Internal image silver halide emulsions useful in this invention are described more fully in the November, 1976 edition of Research Disclosure, pages 76 through 79, the disclosure of which is hereby incorporated by reference.

The various silver halide emulsion layers of a color film assembly employed in this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

Except where noted otherwise, the silver halide emulsion layers employed in the invention comprise photosensitive silver halide dispersed in gelatin and are about 0.6 to 6 microns in thickness. The dye image-providing materials are dispersed in an aqueous alkaline solution-permeable polymeric binder, such as gelatin, as a separate layer about 0.2 to 7 microns in thickness, and the alkaline solution-permeable polymeric interlayers, e.g., gelatin, are about 0.2 to 5 microns in thickness.

Scavengers for oxidized developing aent can be employed in various interlayers of the photographic elements of the invention. Suitable materials are disclosed on page 83 of the November 1976 edition of Research Disclosure, the disclosure of which is hereby incorporated by reference.

The dye image-receiving layers containing the mordants of this invention may also contain a polymeric vehicle as long as it is compatible therewith. Suitable materials are disclosed, for example, in U.S. Pat. No. 3,958,995 and in Product Licensing Index 92, December 1971, Publication No. 9232, page 108, paragraph VIII, the disclosures of which are hereby incorporated by reference.

Use of a neutralizing material in the film units employed in this invention will usually increase the stability of the transferred image. Generally, the neutralizing material will effect a reduction in the pH of the image layer from about 13 or 14 to at least 11 and preferably 5 to 8 within a short time after imbibition. Suitable materials and their functioning are disclosed on pages 22 and 23 of the July 1974 edition of Research Disclosure, and pages 35 through 37 of the July 1975 edition of Research Disclosure, the disclosures of which are hereby incorporated by reference.

A timing or inert spacer layer can be employed in the practice of this invention over the neutralizing layer which "times" or controls the pH reduction as a function of the rate at which alkali diffuses through the inert spacer layer. Examples of such timing layers and their functioning are disclosed in the Research Disclosure articles mentioned in the paragraph above concerning neutralizing layers.

The alkaline processing composition employed in this invention is the conventional aqueous solution of an alkaline material, e.g. alkali metal hydroxides or carbonates such as sodium hydroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November, 1976 edition of Research Disclosure, the disclosure of which is hereby incorporated by reference.

The alkaline solution permeable, substantially opaque, light-reflective layer employed in certain embodiments of photographic film units used in this invention is described more fully in the November, 1976 edition of Research Disclosure, page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November, 1976 edition of Research Disclosure, the disclosure of which is hereby incorporated by reference.

The term "nondiffusing" used herein has the meaning commonly applied to the term in photography and denotes materials that for all practical purposes do not migrate or wander through organic colloid layer, such as gelatin, in the described photographic recording materials in an alkaline medium, and preferably when processed in a medium having a pH of 11 or greater. The same meaning is to be attached to the term "immobile". The term "diffusible" has the converse meaning and denotes material having the property of diffusing effectively through the colloid layers of the photographic recording materials in an alkaline medium. "Mobile" has the same meaning as "diffusible".

The term "in reactive association" is intended to mean that the materials can be in either the same or different layers, so long as the materials are accessible to one another.

Good color correction in accordance with this invention is obtained on negative dye-image transfer intermediates derived from sulfonamidophenol or sulfonamidonaphthol redox dye releasing compounds as the principal RDR compounds and using positive quinone RDR's as the secondary or color correcting compounds. This particular combination provides good results without substantial alteration of imaging sensitometry. Some slight speed loss is observed due to light absorption of the second redox dye releasing compound.

The following examples are based on the use of conventional azo dyes. However, equivalent results would be expected with use of either metallized or metallizable dyes. Unless othewise indicated all parts, percents and ratios are by weight.

EXAMPLE 1

A multicolor image transfer integral imaging receiver was costed containing cyan, magenta, and yellow sulfonamidonaphthol redox dye releasing compounds for primary imaging. Unwanted blue density of the magenta RDR was corrected by use of a yellow colored PRDR. Unwanted green density of the cyan RDR was corrected by use of a magenta colored PRDR. The structure of this coating was as follows. Coverages are shown as (g/m$^2$).

9. Overcoat:
Gelatin (0.86)
8. Yellow Imaging Layer:
Blue-sensitive silver bromoiodide emulsion (0.86), Yellow RDR-I (1.2), gelatin (1.5)
7. Interlayer:
Carey-lea Silver (0.13 Ag), 2,5-didodecylhydroquinone (0.38), gelatin (0.54)
6. Magenta Imaging Layer:
Green-sensitive silver bromoiodide emulsion (0.75), Magenta RDR-II (1.2), Yellow PRDR-III (0.16), Incorporated Reducing Agent-IV (0.15), gelatin (1.8)
5. Interlayer:
Magenta filter dye 4-(2-acetylphenylazo)-N-{4-(2,4,di-t-pentylphenoxy)butyl-1-hydroxy-2-naphthamide (0.38), gelatin (0.54)
4. Cyan Imaging Layer:
Red-sensitive silver bromoiodide emulsion (0.75), Cyan RDR-V (0.59), Magenta PRDR-VI (0.075), Incorporated Reducing Agent-IV (0.086), gelatin (1.1)
3. Opaque Layer:
Carbon (0.16), gelatin (0.54)
2. Stripping Layer:
Stripping Agent-VII (0.075)
1. Receiving Layer:
Poly(styrene-co-N-benzyl-N,N-dimethyl-N-vinylbenzylammonium chloride-co-divinylbenzene (49.5:49.5:1 wt. ratio) (3.2), gelatin (3.2) coated on clear polyester support The emulsions used were polydispersed silver bromoiodide. All emulsions contained appropriate antifoggants and sensitizing dyes. Formaldehyde was used as a hardener at 0.8 percent of the total gelatin weight. The structures of the dye releasing and incorporated reducing agent compounds are:

Yellow RDR-I

-continued
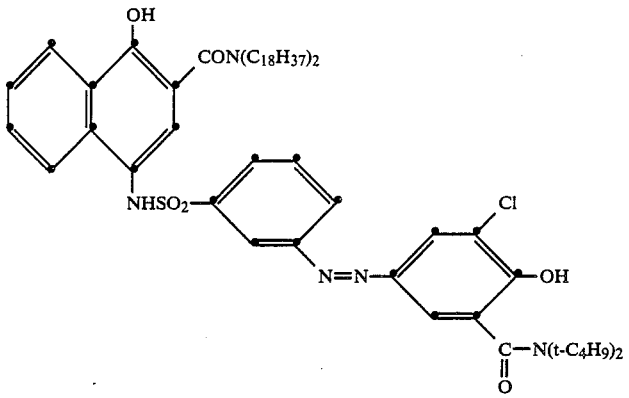
Magenta RDR-II
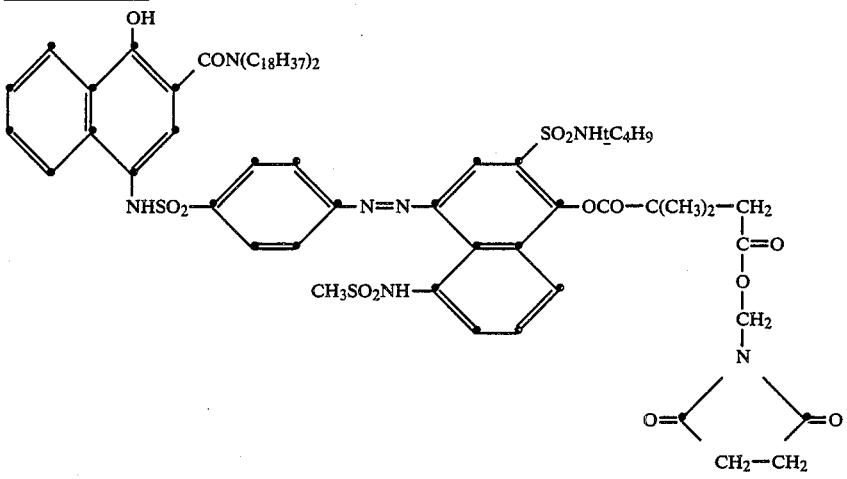
Yellow PRDR-III
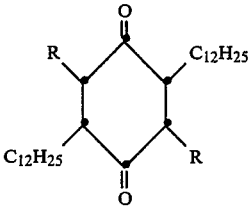
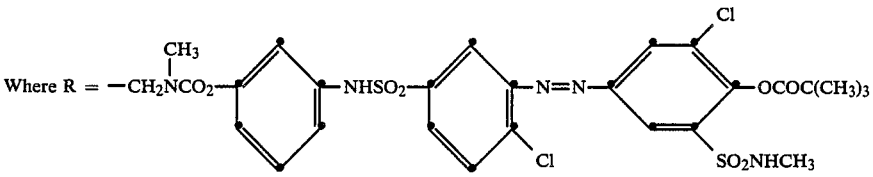
Incorporated Reducing Agent-IV
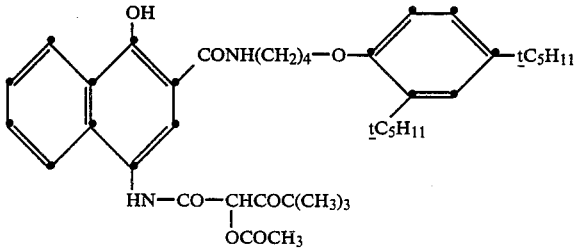
Cyan RDR-V -continued

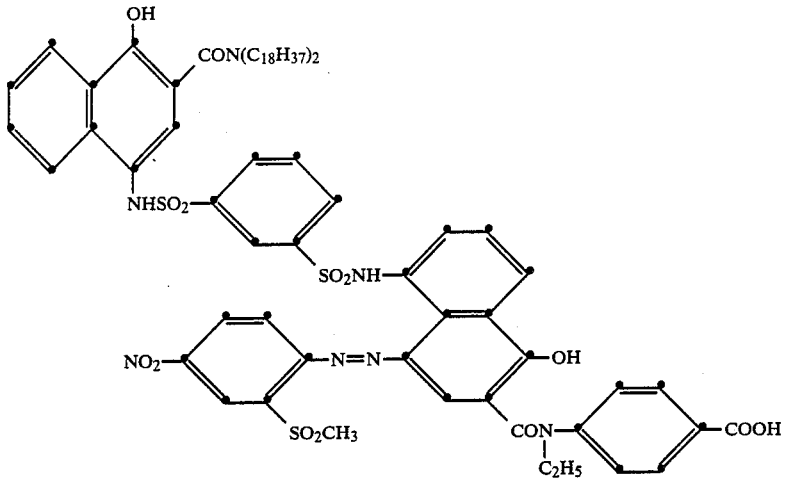

Magenta PRDR-VI

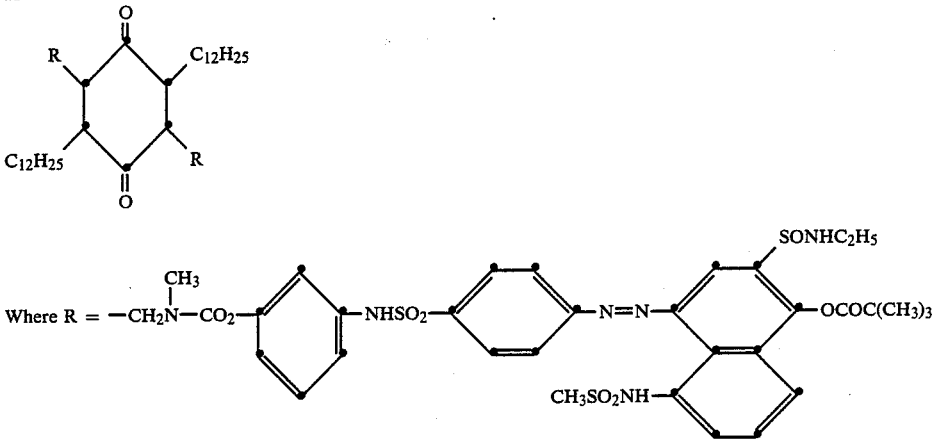

Stripping Agent-VII

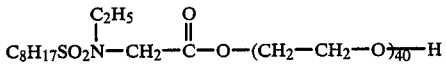

The PRDRs-III and -VI, in layers 6 and 4, respectively, were each codispersed in N,N-diethyllauramide (PRDR:solvent 2:1).

A control coating was prepared identical to the above, but contained no PRDR-III and -IV or Incorporated Reducing Agent-IV.

The processing pods used were of the following composition:

| | |
|---|---|
| 50 g/l | potassium hydroxide |
| 2 g/l | 4-hydroxymethyl-4-methyl-1-phenyl-3-pyrazolidinone |
| 5 g/l | potassium bromide |
| 65 g/l | carboxymethylcellulose |

Each integral imaging receiver was exposed in a sensitometer through a graduated density test object to yield a full-scale image. Two different separation exposures were made: (a) at 1/100 second through a Wratten 99 filter for green light exposure and (b) at 1/25 second through a Wratten 29 filter for red light exposure. Processing occurred at room temperature (~21° C.) by spreading the contents of a pod between the light-sensitive element and a clear polyester cover sheet using a pair of juxtaposed rollers to provide a fluid gap of 75 μm. After 3 minutes the receiver layer was separated by peeling and the Status A transmission densities of the red separation exposure were read to obtain the following data:

| Status A Density - Red Separation | | | | |
|---|---|---|---|---|
| | Control | | Invention | |
| | R | G | R | G |
| Step 1 (D-max) | 1.8 | 0.23 | 1.7 | 0.29 |
| Step 3 | 1.5 | 0.19 | 1.5 | 0.27 |
| Step 5 | 0.8 | 0.14 | 0.7 | 0.25 |
| Step 13 (D-min) | 0.08 | 0.10 | 0.11 | 0.26 |

The data show that the control coating has much more green density at D-max than at D-min. This unwanted green density is proportional to the red density due to unwanted green density of the cyan imaging dye. The coating of the invention, containing a magenta colored PRDR (layer 4), has a more constant green density throughout the exposure scale. These data indicate that most of the unwanted green absorption of the cyan imaging dye is corrected by use of the magenta colored PRDR.

The following Status A densities of the green separation exposure were obtained:

| Status A Density - Green Separation | Control | | Invention | |
|---|---|---|---|---|
| | G | B | G | B |
| Step 1 (D-max) | 1.5 | 0.35 | 1.5 | 0.51 |
| Step 3 | 1.4 | 0.32 | 1.3 | 0.50 |
| Step 5 | 1.0 | 0.28 | 1.0 | 0.47 |
| Step 13 (D-min) | 0.10 | 0.10 | 0.26 | 0.38 |

The data show that the control coating has much more blue density at D-max than D-min. This unwanted blue density is proportional to the green density due to unwanted blue absorption of the magenta imaging dye. The coating of the invention, containing yellow colored PRDR-III (layer 6), has more constant blue density throughout the exposure scale indicating correction of unwanted blue absorption of the magenta imaging dye.

Prints made from scenes exposed on these multicolor negative intermediates showed much more saturated colors from the coating of the invention compared to the control coating without color correction.

EXAMPLE 2

This example demonstrates color correction in a single color format. An image transfer donor element was coated containing a cyan sulfonamidonaphthol redox dye releasing compound (for the primary image), and a yellow quinone positive redox dye releasing compound (for color correction) with a negative working emulsion. Coverages are in (g/m$^2$).

Overcoat:

2,5-Didodecylhydroquinone (0.38) in gelatin (0.65)

Imaging Layer:

Silver bromoiodide emulsion (0.43 Ag), Cyan RDR-V (0.54), yellow PRDR-III (0.16), Incorporated Reducing Agent-IV (0.15), gelatin (1.3)

Coated on clear polyester support

The emulsion used was a polydispersed red-sensitized silver bromoiodide. Bis(vinylsulfonyl)methane was used as a hardener at 1.0 percent of the total gelatin weight. The structures of the dye releasing and the incorporated reducing agent compounds of this example are described above.

The yellow PRDR-III and incorporated reducing agent -IV were codispersed in N,N-diethyllauramide (solid:solvent 2:1).

A control coating was prepared identical to the above, but containing no yellow PRDR-III or incorporated reducing agent -IV;

Processing pods of the following composition were prepared:

| | g/l |
|---|---|
| potassium hydroxide | 35 |
| 4-hydroxymethyl-4-methyl-1-p-tolyl-3-pyrazolidinone | 8 |
| 5-methylbenzotriazole | 3 |
| 11-aminoundecanoic acid | 2 |
| carboxymethylcellulose | 42 |
| carbon | 166 |

Dye image-receiver elements were prepared by coating the following layers, in the order recited, on a transparent poly(ethylene terephthalate) support:

1. Gelatin (0.81 g/m$^2$) plus formaldehyde equal to 1.25% of the total gelatin weight;

2. Dye image-receiving layer of poly[styrene-co-1-vinylimidazole-co-3-(2-hydroxyethyl)-1-vinylimidazolium chloride] (weight ratio 50:40:10) (2.4 g/m$^2$); sorbitol (0.54 g/m$^2$) and gelatin (3.0 g/m$^2$);

3. Interlayer of 2-(2-hydroxy-3,5-di-t-amyl-phenyl)-benzotriazole (0.54 g/m$^2$) and gelatin (0.86 g/m$^2$); and (4) Gelatin (0.65 g/m$^2$) containing zinc sulfate (0.04 g/m$^2$).

Each light-sensitive donor element was exposed in a sensitometer to white light at 1/25 second through a graduated density test object to yield a full-scale image. Processing occurred at room temperature (~21° C.) by spreading the contents of a processing pod between a donor element and a receiver element using a pair of juxtaposed rollers to provide a fluid gap of 75 μm. After 150 seconds, the lamnated unit was separated and the Status A transmission density values were read to obtain the following data.

| | (Status A Density) | | | |
|---|---|---|---|---|
| | Control | | Invention | |
| | R | B | R | B |
| Step 1 (D-max) | 1.6 | 0.16 | 1.5 | 0.16 |
| Step 3 | 1.4 | 0.14 | 1.1 | 0.14 |
| Step 5 | 0.9 | 0.12 | 0.5 | 0.11 |
| Step 13 (D-min) | 0.06 | 0.06 | 0.06 | 0.23 |

The data show that the control coating has significantly more blue density at D-max than at D-min. This unwanted blue density is proportional to the red density due to unwanted blue absorption of the cyan imaging dye. The coating of the invention, which contains a yellow PRDR for color correction, has a more constant blue density throughout the exposure scale indicating correction of the unwanted blue absorption of the cyan imaging dye. The higher blue density at Step 13 indicates an overcorrection. Use of lower quantities of this yellow PRDR would permit optimization of this value.

This invention has been described in detail with particular reference to preferred embodiments thereof. However, it will be apparent that variations and modifications can be effected within the spirit and scope of the invention.

What is claimed is:

1. A color diffusion transfer photographic recording material comprising a support having thereon at least one photosensitive silver halide emulsion layer having associated therewith a positive working redox dye image-providing compound and a negative working redox dye image-providing compound each of which compounds being nondiffusible in alkaline medium having a pH of 11 or greater, whereby both a positive and a negative diffusion transfer dye image can be formed, wherein one of said compounds releases dye as a direct function of silver halide development and the other of said compounds releases dye as an inverse function of silver halide development to provide color correction for the dye image.

2. A recording material according to claim 1 wherein one of said nondifussible compounds is a positive-working quinone redox compound.

3. A recording material according to claim 2 wherein said positive-working compound provides a secondary, color correcting dye image.

4. A recording material according to claim 1 wherein one of said nondiffusible compounds is a negative-working sulfonamidophenol or a sulfonamidonaphthol compound.

5. A recording material according to claim 4 wherein said negative-working compound provides a principal transfer dye image.

6. An element according to claim 3 wherein said nondiffusible redox dye image-providing compound which provides said secondary color correcting dye image is present in an amount up to about 35% by weight of the amount of nondiffusible redox dye releasing compound employed for the principal imaging.

7. A process for producing a color corrected photographic transfer image which comprises:

(I) imagewise exposing a photosensitive element comprising a support having thereon at least one photosensitive silver halide emulsion layer having associated therewith two nondiffusible redox dye releasing compounds, each capable of releasing a diffusible dye, wherein one of said compounds releases dye as a direct function of silver halide development and the other of said compounds releases dye as an inverse function of silver halide development;

(II) treating the exposed element with an alkaline processing composition in the presence of a silver halide developing agent to effect development of each exposed silver halide emulsion layer, whereby:

(a) an imagewise distribution of a principal dye released from an image-providing material is formed as a direct function of development of the silver halide layer and, simultaneously, (b) an imagewise distribution of a secondary dye released from an image-providing material is also formed as an inverse function of silver halide development, and (c) at least a portion of each of said imagewise distributions of released dye diffuses to a dye image-receiving layer to provide a negative image in one dye and a positive image in the other dye to accomplish color correction in the principal transferred dye image, and, optionally, (III) separating the dye image-receiving layer from the remainder of the photosensitive element.

* * * * *